US006250584B1

(12) United States Patent
Hsu et al.

(10) Patent No.: US 6,250,584 B1
(45) Date of Patent: Jun. 26, 2001

(54) MISSILE FIN LOCKING MECHANISM

(75) Inventors: William W. Hsu, Glendale; Duncan D. Bragg, Simi Valley, both of CA (US)

(73) Assignee: HR Textron, Inc., Valencia, CA (US)

( * ) Notice: Subject to any disclaimer, the term of this patent is extended or adjusted under 35 U.S.C. 154(b) by 0 days.

(21) Appl. No.: 09/419,544

(22) Filed: Oct. 18, 1999

(51) Int. Cl.[7] ..... F42B 10/06
(52) U.S. Cl. ..... 244/3.24; 244/3.21
(58) Field of Search ..... 244/3.21, 3.24, 244/224

(56) References Cited

U.S. PATENT DOCUMENTS

| | | | | |
|---|---|---|---|---|
| 2,952,207 | * | 9/1960 | Kamimoto . | |
| 3,001,474 | | 9/1961 | McLean et al. . | |
| 3,093,075 | * | 6/1963 | Garrett et al. | 244/3.24 |
| 3,154,015 | | 10/1964 | Muller . | |
| 3,697,019 | | 10/1972 | Watson . | |
| 3,711,040 | | 1/1973 | Carver . | |
| 3,764,091 | | 10/1973 | Crowhurst . | |
| 4,141,520 | | 2/1979 | Beijer et al. . | |
| 4,173,322 | | 11/1979 | Macdonald . | |
| 4,374,577 | * | 2/1983 | Brown et al. | 244/3.21 |
| 4,738,412 | * | 4/1988 | Ozunas | 244/3.21 |
| 4,795,110 | | 1/1989 | Lang . | |
| 5,127,605 | | 7/1992 | Atchison et al. . | |
| 5,192,037 | | 3/1993 | Moorefield . | |
| 5,409,185 | | 4/1995 | Oldakowski . | |
| 5,504,408 | | 4/1996 | Speicher et al. . | |
| 5,904,319 | | 5/1999 | Hetzer . | |
| 5,950,963 | | 9/1999 | Speicher et al. . | |

FOREIGN PATENT DOCUMENTS

| | | |
|---|---|---|
| 4025-516 | 2/1992 | (DE) . |
| 4-288499 | 10/1992 | (JP) . |

* cited by examiner

*Primary Examiner*—Charles T. Jordan
*Assistant Examiner*—Tim Dinh
(74) *Attorney, Agent, or Firm*—Fulbright & Jaworski L.L.P.

(57) ABSTRACT

A locking mechanism for moveable control fins extending from the surface of a missile. The locking mechanism includes a pin extending thru the outer surface of the missile into an opening provided in the movable fin. A link is pivotally connected between each of the pins and a slide member disposed internally of the missile and carried by a guide. The links are in a close to dead center position when the pins are extended into the openings in each of the fins. Upon a command signal from a controller, preparatory to missile launch, a restraining device holding the slide is removed and a spring commences movement of the slide toward a position which will take the links past their dead center position upon which additional springs which are loaded around each of the pins are activated to positively move the slide and extract the pins from the openings in the fins.

10 Claims, 3 Drawing Sheets

FIG. 5
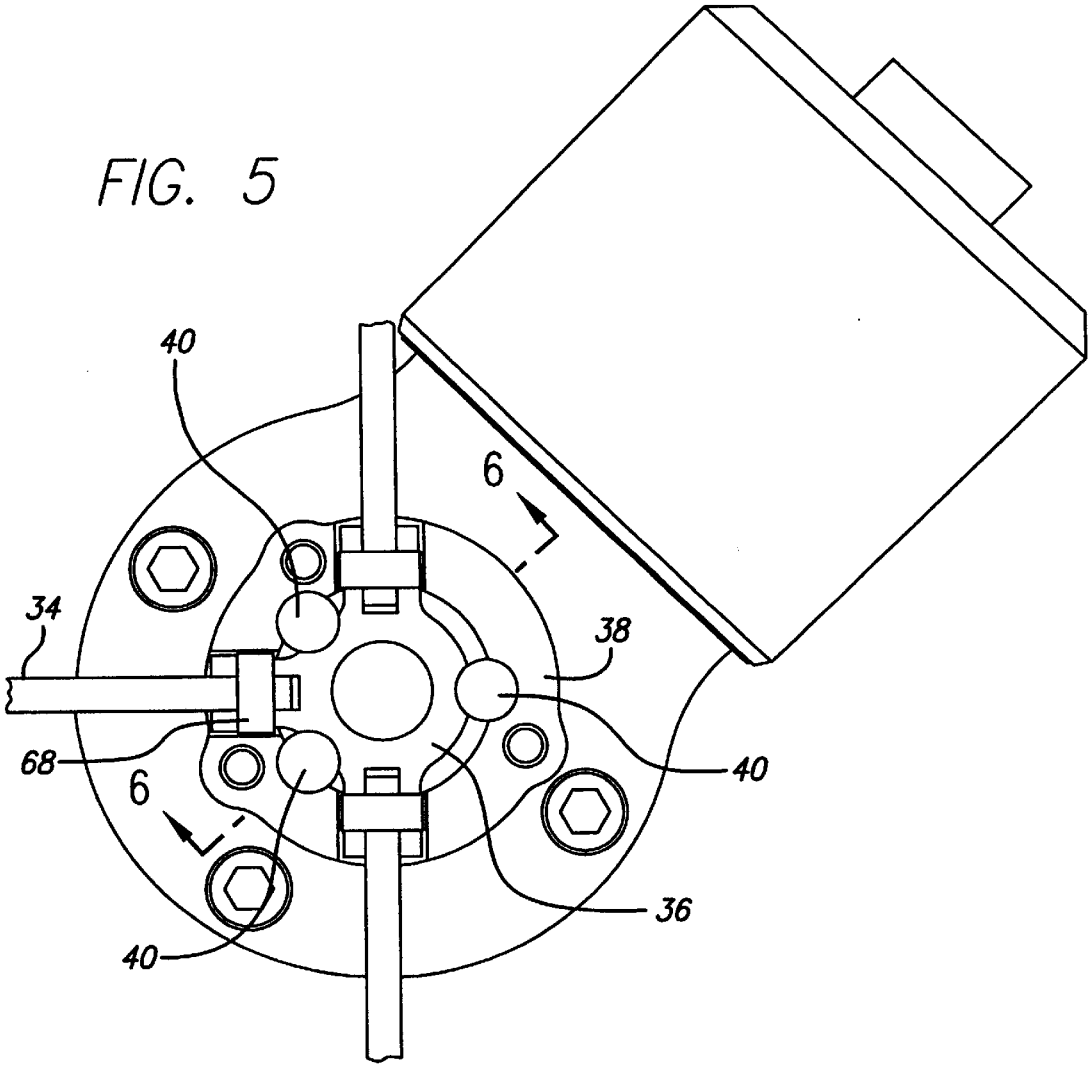
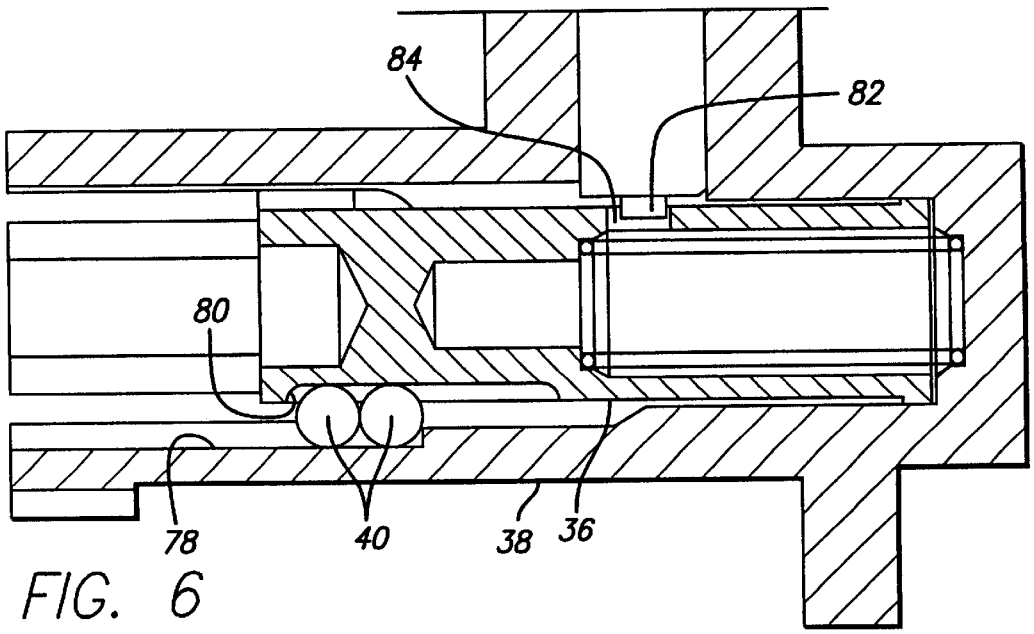
FIG. 6

MISSILE FIN LOCKING MECHANISM

FIELD OF THE INVENTION

The present invention relates to moveable control fins for missiles carried on aircraft and more particularly to a system for locking the fin against aerodynamic loads and preventing the transmission of these loads through the drive train.

DESCRIPTION OF THE PRIOR ART

Flight control systems of many diverse types have been widely utilized. They generally include a control surface and in the case of a missile the control surface is typically a fin. Generally the control surface or fin is moveable for purposes of flight control. The fin shaft is generally connected through an output shaft that is rotated by connection to an appropriate drive train to a power source.

During flight before launch when the missile is positioned on the exterior of the aircraft the fin is subjected to high aerodynamic loading. This loading causes the fin to move in the direction of the load and in turn causes the fin shaft to rotate which rotation is transmitted through the drive train causing flutter and fatigue failures. Such is the case even when a brake mechanism is utilized in an attempt to stop the rotation of the fin shaft or the output shaft.

As a result of this undesirable aerodynamic loading of the drive train, various attempts have been made to provide a lock which would eliminate the aerodynamic loading. Examples of such locks designed particularly for utilization upon missiles utilizing control fins are shown in U.S. Pat. Nos. 4,759,110; 5,409,185 and 5,505,408. Unfortunately, most locks for control surfaces such as fins on missiles have failed in numerous respects. For instance, some of the locks have been prone to sticking or otherwise failing to release upon command in a substantially frictionless fashion. Some locks have been prone to inadvertent unlatching due to vibration during normal operation. Other locking mechanisms are quite complex and include a large number of parts all of which must operate properly to avoid a malfunction.

SUMMARY OF THE INVENTION

The present invention is directed to a locking mechanism for use on a missile having a plurality of moveable control fins extending from an outer surface thereof, the locking mechanism includes a locking pin for each of the moveable control fins which is adapted to extend through the outer surface of the missile into an opening in the control fin to retain the control fin in a fixed position prior to launch, a slide member moveable between a pin extend and a pin extract position with a plurality of links one coupling each of the pins to the slide. When the slide member is in its pin extend position each of the links is positioned in a substantially dead center position. Means is provided for initiating movement of the slide member away from its pin extend position and additional means is provided for positively moving the slide member from its pin extend position to its pin extract position to remove each of the pins from the opening in its respective moveable control fin.

BRIEF DESCRIPTION OF THE DRAWING

FIG. 5 is a view similar to FIG. 2 without the pins and with the cover removed; and FIG. 6 is a partial cross-sectional view taken about the line 6—6 of FIG. 5.

DETAILED DESCRIPTION OF THE INVENTION

Figure 1:
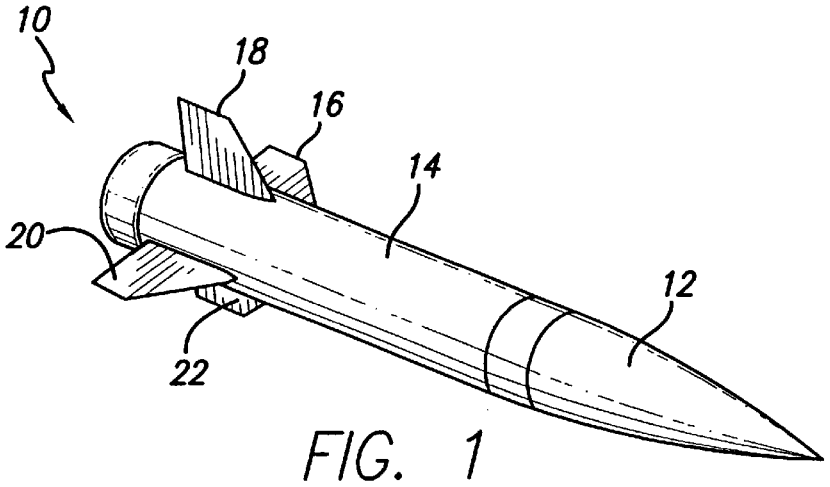
FIG. 1 is a schematic representation of a missile which may utilize a locking mechanism for its control fins constructed in accordance with the principles of the present invention.

Shown generally at (10) in FIG. 1 is a missile (12) which may be carried by appropriate fittings (not shown) underneath the wing of an aircraft for ultimate launching at a target. Attached to an outer surface (14) of the missile is a plurality of fins (16–22) which as illustrated are disposed 90° apart around the circumference of the missile. Although four such control fins are shown in this particular drawing it should be understood that a lesser or greater number may be utilized depending upon the particular missile and its intended missions. All or some of the fins (16–22) may be moveable for purposes of controlling the direction of flight both in yaw and pitch in accordance with a guidance mechanism included within the missile. For example, one such guidance mechanism may utilize Global Positioning System (GPS) signals as is well known to direct the missile to a desired target which has been preprogramed into the guidance system of the missile. Thus, after launch the GPS signals are utilized to provide motion to an appropriate drive mechanism which is connected by a drive train to a shaft upon which the fins (16–22) are mounted to effect movement of one or more of the fins to thus control the flight path of the missile.

As above referred to, while the missile (12) is affixed to the exterior to the aircraft and before launch, the fins (16–20) are subjected to aerodynamic loads as the aircraft carrying the missile moves through the atmosphere. These aerodynamic loads can cause movement to the fins thus causing them to improperly direct the flight path of the missile (12) after launch or alternatively may apply such loads to the drive train deleteriously affecting it and cause failure of the missile as a result of fatigue, strain or failure of the drive train as a result of the application of the aerodynamic loads.

Figure 3:
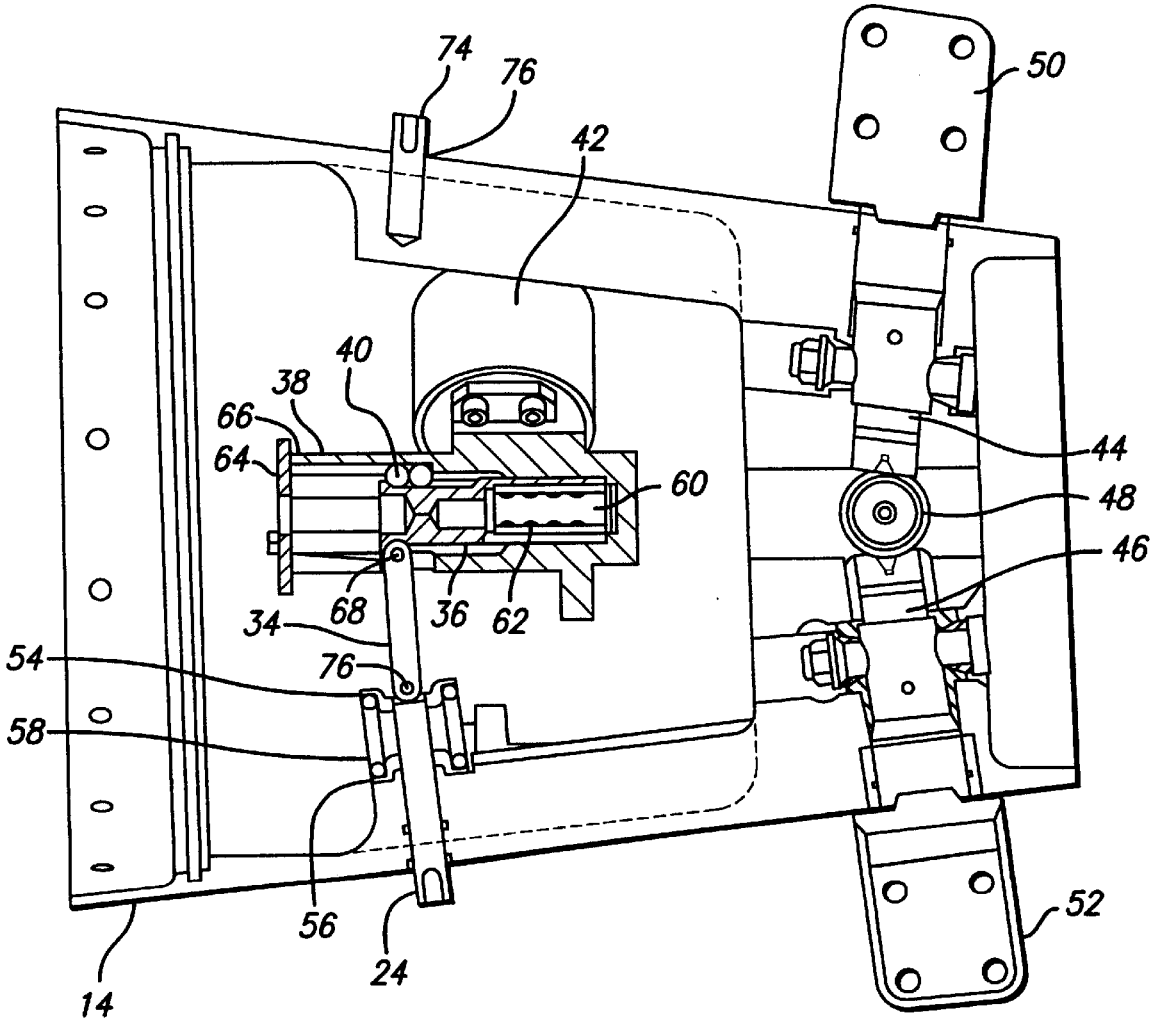
FIG. 3 is a partial cross-sectional view of the device of FIG. 2 taken without the lines 3—3 thereof.
Figure 2:
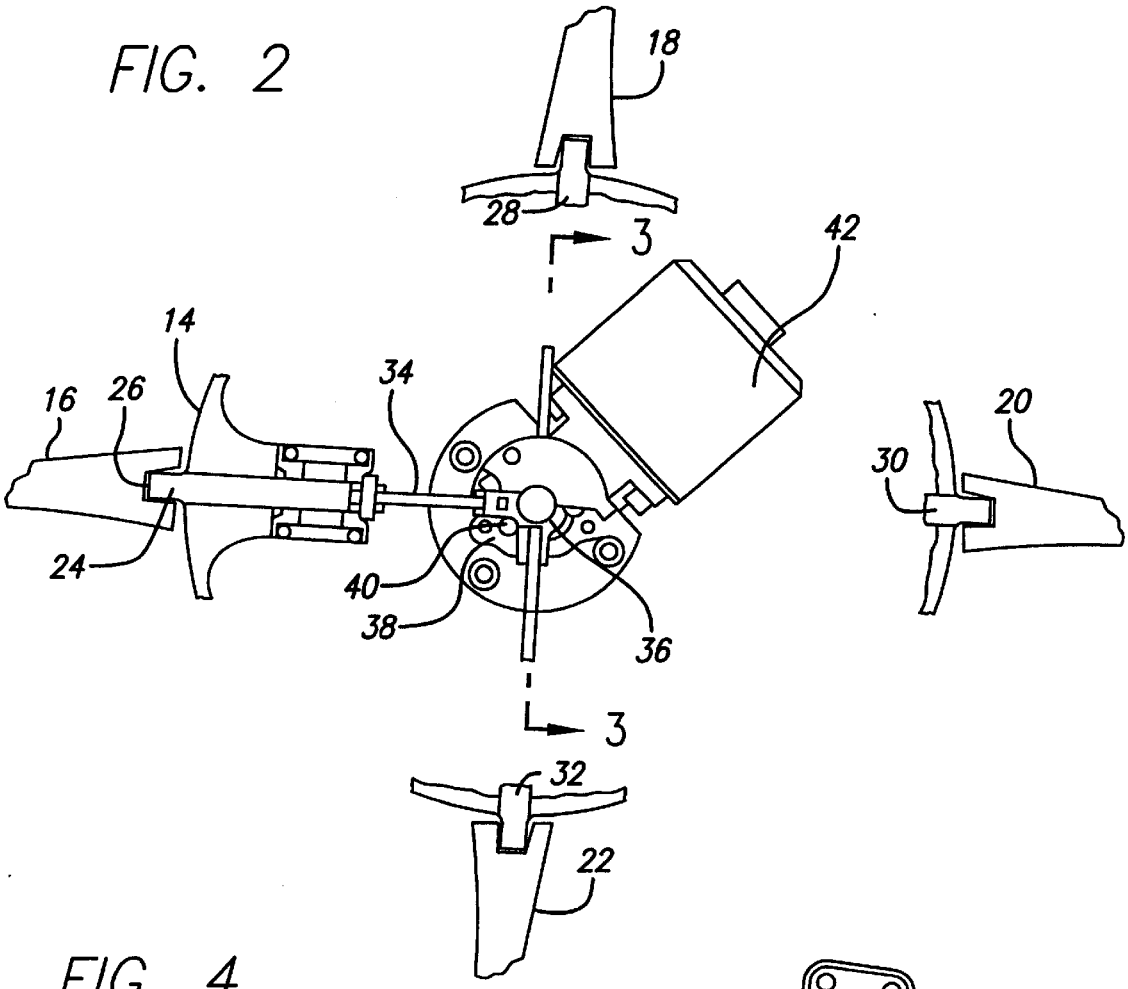
FIG. 2 is a rear view in partial cross-section of a locking mechanism construed in accordance with the present invention shown in its locked position.
Figure 4:
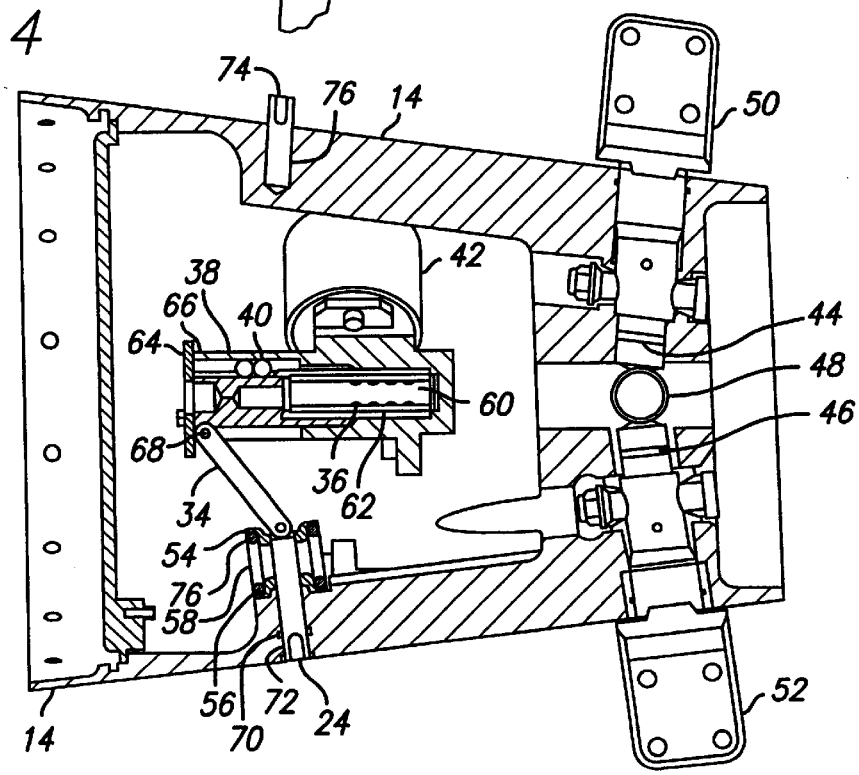
FIG. 4 is a view similar to that of FIG. 3 but showing the locking mechanism in its unlocked position.

As is shown particularly in FIG. 2, a plurality of locking pins such as shown at 24, one for each of the fins (16–22) are adapted to extend outwardly away from the outer surface (14) of the missile (12) and into engagement with an opening (26) which is provided internally of the control fin (16). Through the utilization of the pin (24) and having it inserted into an opening such as shown at 26 the fin (16) is held rigidly in place in its null position until such a time as the pin (24) is retracted from the opening (26). Similarly locking pins (28), (30) and (32) are shown engaging appropriate openings within the fins (18), (20) and (22). Each of the locking pins (24), (28), (30) and (32) is coupled by an appropriate link mechanism such as that shown at (34) to a slide member (36) which is disposed within a guide (38) for movement between a pin extend position as shown in FIG. 3 and a pin extract position as is shown in FIG. 4. The slide member (36) is mounted within the guide (38) upon a plurality of balls (40) which enables substantially friction free movement of the slide member (36) within the guide (38) between the extend and retract positions. An appropriate restraining member engages the slide (36) when it is in its pin extend position to prevent any inadvertent actuation of the system as a result of vibration loads or the like which would tend to cause the slide to move from its pin extend position as shown in FIGS. 2 and 3 to the pin extract position as shown in FIG. 4 accidentally. A solenoid (42) is utilized to release the restraint on the slide (36) in response to an unlock command applied thereto from an appropriate controller operated by the aircraft pilot or autopilot preparatory to launch of the missile.

Referring now more particularly to FIG. 3 the structure as is illustrated in FIG. 2 is illustrated in greater detail. As is therein shown, fin shafts (44) and (46) are connected to an appropriate drive train (48) which provides drive power to the pin shafts (44) and (46) to rotate the shafts to provide appropriate directional control for the missile. The shafts (44) and (46) terminate in fittings (50) and (52), respectively, to which fins such as those shown at (16) and (20) may be affixed for purposes of ease of illustration and clarity of description the fins have been eliminated from FIGS. 3 and 4. As is shown in FIG. 3 the link (34) is attached by way of a link pivot pin (76) to the locking pin (24). At the juncture between the link (34) and locking pin (24) there is provided a spring retainer (54) and also surrounding the pin (24) and adjacent the surface (14) is an additional spring retainer (56). Disposed between the retainers (54) and (56) is a spring (58) which as will be described more fully below is placed in compression when the slide member (36) is in its pin extend position as shown in FIG. 3. As is also illustrated the slide member (36) defines a bore (60) therein which receives a compression spring (62) which is placed in compression when the slide is in its pin extend position as shown in FIG. 3. An appropriate stop mechanism (64) is disposed on the end (66) of the guide member (38) to stop the movement of the slide (36) when it moves to its pin extract position.

As is also illustrated the link (34) is connected at the pivot (68) to the slide member (36). It is therefore seen that the link couples the pin (24) to the slide (36) thereby causing the pin (24) to reciprocate between its extended position and its extracted position as the slide moves between its pin extend position and pin extract position. It should also be noted that O-rings (70) and (72) may surround the pin (24)just beneath the surface (14) of the missile.

Under some circumstances a fin may be affixed to the missile but not used for control of the missile flight path but rather as a stabilizing fin. Under such circumstances, a pin such as that shown at (74) may extend outwardly through an opening provided in the surface (14) of the missile and may also have an O-ring (76) extending therearound. However, the pin (74) would not be retracted but would remain in the fixed position as shown in FIGS. 3 and 4 at all times after assembly including after launch.

Referring now to FIG. 5, the slide (36) is shown disposed internally of the guide (38) and with the balls (40) disposed therebetween to assist in reciprocal movement of the slide (36) within the guide (38) into and out of the plane of the drawing as shown in FIG. 5. As is illustrated, the lengths, such is shown at (34) are each connected by an appropriate pivot pin such as shown at (68) to the slide (36).

FIG. 6 further shows the guide (36) in its position locking the pins in their pin extend position with the balls (40) riding in the crack (78–80). As is also clearly illustrated in FIG. 6, the restraining member (82) extends into an opening (84) provided in the slide (36) to restrain it when it is in the position as illustrated in FIG. 6 and as above described.

In operation of a fin locking mechanism constructed in accordance with the principles of the present invention, the missile would be assembled with the fins in their locked position. That is, upon assembly of the missile the fins would be attached to the members (50) and (52) and would then be positioned such that the opening as shown for example at (26) would be immediately adjacent the opening in the surface 14 through which the pin (24) would extend. The slide (36) would then be pushed to its pin extend position as shown in FIG. 3 thus causing the pins for example at (24), (28), (30) and (32) to extend through the openings in the surface (14) and into the openings in the fins (16), (18), (20) and (22). The restraining mechanism would then be engaged to assure that the slide member (36) remained in its pin extend position. It should be noted that when the slide (36) is moved through its pin extend position the links such as (34) are positioned in their close to dead center position thereby asserting no force on the slide member (36). It should also be noted that when the slide (36) is moved to its pin extend position, the springs (58) and (62) are placed in their full compression position. In accordance with the principles of the present invention, the spring creating the most force is the spring (58) which would be used to positively assure that the slide (36) is moved to its pin extract position upon receipt of the appropriate command signal. However since the links such as that shown at (34) is in substantially dead center position merely removing the restraining force from the slide (36) will not necessarily cause it to commence to move to the pin extract position. Therefore, the spring (62) is provided and as shown is seated within the bore (60) of the slide member (62) and seats against the guide member (38) therefore, continuously urging the slide (36) towards its pin extract position, however, because the restraining member has been activated the slide (36) cannot move until the restrain is removed.

After assembly of the fins in their locked position as above described the missile (12) will be loaded upon the aircraft and the aircraft would take flight toward the predetermined area so that it may accomplish its mission. Upon detection of the desired target whether it be a surface target or an air target, depending upon the particular mission of the missile involved, and at the desired time of launch an appropriate control signal from the controller would be applied to the solenoid (42) releasing the restraining device from engagement with the slide member (36). When the unlock command is received and the solenoid is activated to release the restraint on the slide (36), the spring (62) will then urge the slide towards its pin extract position. As soon as the slide commences to move on the balls (40) towards the left as viewed in FIG. 3 the links (34) are displaced from their close to dead center position. Immediately upon the links moving passed the dead center position the springs (58), which as above noted, generate the greatest amount of force are activated and move the links forcibly downward as viewed in FIGS. 3 and 4 and as particularly shown in FIG. 4 thus positively moving the slide (36) towards the left as viewed in FIGS. 3 and 4. Since all of the links are coupled to the slide, the links will be simultaneously moved thereby positively extracting the pins from the openings in the fins. In this condition the control signals received from the guidance system in the missile can appropriately move the shafts such as shown at (44) and (46) to cause the fins to move appropriately to control the flight path of the missile.

There has thus been disclosed a locking mechanism for use on a missile to lock moveable control fins extending from the surface thereof in null positions to thereby eliminate the application of aerodynamic loads to the drive train of the missile.

What is claimed is:

1. A locking mechanism for use on a missile having a plurality of movable control fins extending from an outer surface thereof, said mechanism comprising:

a locking pin for each movable control fin adapted to extend through said outer surface into an opening in said control fin to retain said control fin in a fixed position prior to said missile being activated;

a slide member movable between a pin extend and a pin extract position; a plurality of links, one for each locking pin, coupling each said pin to said slide;

each of said links being positioned in substantially a dead center position when said slide member is in its pin extend position;

means for initiating movement of said slide member away from its pin extend position; and means for positively moving said slide member from its pin extend position to its pin extract position to remove each said pin from each said opening in its respective movable control fin.

2. A locking mechanism as defined in claim 1 which further includes a slide member guide, said slide member being seated within said guide for movement therein between said positions.

3. A locking mechanism as defined in claim 2 which further includes means for releaseably securing said slide member in its pin extend position.

4. A locking mechanism as defined in claim 3 wherein said means for initiating movement of said slide member includes a solenoid which upon receipt of a command signal deactivates said means for releaseably securing.

5. A locking mechanism as defined in claim 4 wherein said means for positively moving said slide member includes a first resiliently deformable means continuously urging said slide member toward its pin extract position.

6. A locking mechanism as defined in claim 5 which further includes means for continuously urging each said pin from its extended position toward its retracted position disposed at each said pin.

7. A locking mechanism as defined in claim 6 wherein said means for urging each said pin includes a separate spring coupled to each said link.

8. A locking mechanism as defined in claim 2 which further includes a plurality of balls disposed between said slide member and said slide member guide to reduce the friction there between.

9. A locking mechanism as defined in claim 5 wherein said slide member defines a bore therein and said first resiliently deformable member is a first spring received within said bore.

10. A locking mechanism as defined in claim 1 which further includes a pivot pin at each end of each said link for pivotally attaching each said link between said slide member and a respective one of said locking pins.

* * * * *